US010190064B2

(12) United States Patent
Kumar et al.

(10) Patent No.: US 10,190,064 B2
(45) Date of Patent: Jan. 29, 2019

(54) INTEGRATED PROCESS FOR SIMULTANEOUS REMOVAL AND VALUE ADDITION TO THE SULFUR AND AROMATICS COMPOUNDS OF GAS OIL

(71) Applicant: Council of Scientific & Industrial Research, New Delhi (IN)

(72) Inventors: Sunil Kumar, Dehradun (IN); Shrikant Madhusudan Nanoti, Dehradun (IN); Madhukar Onkarnath Garg, Dehradun (IN); Bhagat Ram Nautiyal, Dehradun (IN); Prasenjit Ghosh, Dehradun (IN); Pooja Yadav, Dehradun (IN); Nisha, Dehradun (IN)

(73) Assignee: Council of Scientific & Industrial Research, New Delhi (IN)

( * ) Notice: Subject to any disclaimer, the term of this patent is extended or adjusted under 35 U.S.C. 154(b) by 251 days.

(21) Appl. No.: 15/077,707

(22) Filed: Mar. 22, 2016

(65) Prior Publication Data

US 2016/0281008 A1 Sep. 29, 2016

(51) Int. Cl.

| | |
|---|---|
| ***C10G 1/00*** | (2006.01) |
| ***C10G 67/00*** | (2006.01) |
| ***C10G 7/06*** | (2006.01) |
| ***C10G 21/28*** | (2006.01) |

(52) U.S. Cl.

CPC ..... *C10G 67/00* (2013.01); *C10G 7/06* (2013.01); *C10G 21/28* (2013.01)

(58) Field of Classification Search

CPC . C10G 7/00; C10G 7/06; C10G 67/00; C10G 21/00; C10G 21/02; C10G 21/06; C10G 21/12; C10G 21/14; C10G 21/16; C10G 21/20; C10G 21/28; C10G 53/04; C10G 53/06; C10B 55/00

See application file for complete search history.

(56) References Cited

U.S. PATENT DOCUMENTS

| | | | | |
|---|---|---|---|---|
| 4,746,420 A * | 5/1988 | Darian | ..... | C10G 21/00 208/15 |
| 6,087,544 A * | 7/2000 | Wittenbrink | ..... | C10G 45/02 44/300 |
| 2013/0186805 A1 * | 7/2013 | Koseoglu | ..... | C10G 45/08 208/89 |

* cited by examiner

*Primary Examiner* — Prem C Singh
*Assistant Examiner* — Brandi M Doyle
(74) *Attorney, Agent, or Firm* — DLA Piper LLP (US)

(57) ABSTRACT

An integrated process for simultaneous removal and value addition to sulfur and aromatics compounds of gas oil is provided. Process includes the segregation of refractive sulfur and aromatics compounds of gas oil in heavy fraction of gas oil using distillation processing of heavy fraction of gas oil in continuous solvent extraction zone, processing of lighter fraction of gas oil and raffinate of heavy fraction of gas oil in hydrotreating reaction zone operating under mild conditions of temperature and pressure for producing the gas oil with reduced sulfur and aromatic compounds and contact of extract phase generated during continuous extraction with water in mixer settler for generating the pseudo raffinate which can be used as suitable feed to hydrocracker to generate sulfur lean gas oil.

14 Claims, 2 Drawing Sheets

PFPD spectra of Gas oil (GO)

PFPD spectra of Lighter fraction of gas oil (LFGO)

PFPD spectra of Heavy fraction of gas oil (HFGO)

INTEGRATED PROCESS FOR SIMULTANEOUS REMOVAL AND VALUE ADDITION TO THE SULFUR AND AROMATICS COMPOUNDS OF GAS OIL

CROSS-REFERENCE TO RELATED APPLICATIONS

This application is a utility application and claims the benefit under 35 USC § 119(a) to India Patent Application No. 0793/DEL/2015 filed Mar. 23, 2015. The disclosure of the prior application is considered part of and is incorporated by reference in the disclosure of this application.

BACKGROUND OF THE INVENTION

Field of the Invention

The present invention relates to an integrated process for simultaneous removal and value addition to the sulfur and aromatics compounds of gas oil. More particularly, the present invention relates to the innovative application of salient features of distillation, solvent extraction and hydrodesulphurization processes to provide an efficient, cost effective and environment friendly integrated process for gas oil processing resulting in drastic performance enhancement of hydrotreating zone for removal of sulfur, enhancement in cetane number and value addition to its sulfur and aromatics compounds of gas oil.

Background Information

Sulfur limitation in gas oil was initially being implemented to reduce the emissions of the oxides of sulfur, generated during the combustion, which leads to acid ozone and smog and to meet the sulfur specification required for its processing in secondary process. The performance of emission control technologies is adversely affected by sulfur, polyaromatics and nitrogen compounds in gas oil. Therefore, continuously increasing trend of producing the ultra-clean gas oil with strict specifications of sulfur and polyaromatics in gas oil is an effort to reduce the automobile emissions such as oxides of sulfur oxides of nitrogen (NOx), sunburn hydrocarbon compounds (HC) and particulate matter (PM) by reducing the sulfur and PAH in gas oil and to facilitate the implementation of advanced emission control technologies [DECSE; AECC; Koltai, T., 2002].

Hydrotreating is the most commonly used process in refinery for removal of sulfur and reducing the di and polyaromatics content in gas oil. Gas oil contains sulfur species including sulfides, thiols, thiophenes, benzothiophene, dibenzothiophene, a benzonaphthaothiophene with and without alkyl substituents [Hua R. et al.; Journal of chromatography A: Volume 1019, issue 1-2, Nov. 26, 2003 pp. 101-109]. Paul R. Robinson and Geoffrey E. Dolbear reported that rate of hydrodesulfurization is strong function of nature of sulfur compound. The relative rates of various sulfur compounds have been tabulated in Table 1. [Paul R. Robinson and Geoffrey E. Dolbear; Hydrotreating and hydrocracking: Fundamentals; Practical Advances in Petroleum Processing (Chang S. Hsu, Paul R. Robinson, ISBN: 978-0-387-25811-9), pp. 177-218].

TABLE 1

Relative Rate of Hydrodesulphurization of Sulfur Compounds

| Sulfur compound | Relative HDS rate | Remark |
|---|---|---|
| Thiophene | 100 | easy |
| Benzothiophene | 50 | easy |

TABLE 1-continued

Relative Rate of Hydrodesulphurization of Sulfur Compounds

| Sulfur compound | Relative HDS rate | Remark |
|---|---|---|
| Dibenzothiophene | 30 | difficult |
| 4-Methy dibenzothiophene | 5 | More difficult |
| 4,6-Dimethyldibenzothiophene | 1 | Most difficult |
| 2,3,6-Trimethy dibenzothiophene | 1 | Most difficult |

It is clear that alkyl substituted dibenzothiophes and debenzonapthiophene are refractive sulfur compounds for desulfurization. Further, it is well reported in literature that condensed polyaromatics in gas oil inhibits the desulfurization of refractive sulfur compounds significantly due to competitive adsorption of these aromatics on catalyst active sites [T. Koltai, M. Macauda, A. Guevara, E. Schulz. Comparative inhibiting effect of polycondensed aromatics and nitrogen compounds on the hydrodesulfurization of alkyldibenzothiophenes].

Therefore, deep reduction of sulfur and poly aromatics in gas oil using hydrotreating requires either constriction of new high pressure hydrotreating unit or substantial retrofitting of existing hydrotreating facilities, e.g., by integrating new high pressure rector with the existing reactor, by increasing catalyst volume, by using higher hydrogen to oil ratio, by incorporating gas purification system, by reengineering of reactor internals configuration, by employment of more reactive catalyst etc. Retrofitting of existing facilities shall also requires either new equipment or revamp of existing equipment such as makeup compressor due to significant increase in hydrogen consumption, recycle gas compressor due to increased recycle gas flow and pressure drop, vessels due to hydraulic issues, and the amine treating unit for the treating the additional gas rate. Moreover, installation of new grass root hydrogen plant or revamp of existing $H_2$ plant for capacity enhancement would also be required to meet significant increase in $H_2$ consumption due to high severity and polyaromatics saturation. All these options lead to massive initial plant capital investment. Further, severe operating conditions requirement leads to significant increase in operational cost and higher GHG emission to environment [E. R. Palmer, PTQ; Ismagilov, Z.; Less Harwell].

Considering above, refiners are seriously looking for alternative nonconventional processes which could be cost effective, flexible and environment friendly. The development of nonhydrotreating processes for desulfurization of gas oil has been widely studies. Some processes are based on oxidative desulfurization which includes the solvent extraction and adsorption process to remove the oxidized sulfur compounds from oxidized middle distillate. Oxidative desulfurization seems attractive for several reasons; relatively mild operating conditions, e.g., temperature from room temperature to 200° C., pressure from 1 to 15 atmospheric; higher reactivity of refractive sulfur compounds due to high electron density at the sulfur atom caused by attached electron rich aromatic rings. Electron density is further increased with presence of additional alkyl groups on the aromatic rings. [Otsuki, S. et al. oxidative desulfurization of light gas oil and vacuum gas oil by oxidation and solvent extraction. Energy and fuels. 14:1232-1239 (2000)].

Moreover, some integrated desulfurization processes incorporating both hydrodesulphurization and oxidative desulfurization are also reported in literature. The brief summary of some of the references disclosing the integrated processes are given below:

Cabrera et al. U.S. Pat. No. 6,171,478 discloses a process where hydrocarbon feed stock is first hydro treated in hydrotreating reaction zone containing hydrodesulphurization catalyst to remove certain sulfur compounds. Hydro treated stream is then contacted with the oxidant and catalyst in oxidation zone to oxidize the sulfur compounds. The oxidized sulfur compounds are removed from the oxidized hydrocarbon stream using the selective solvent extraction. Adsorption step is used to polish the oxidized sulfur compounds lean stream to reduce the sulfur content to desired level. Finally, stream containing oxidized sulfur compounds and hydrocarbon stream with reduced sulfur are obtained.

Kocal U.S. Pat. No. 6,277,271 disclose a process integrating the hydrodesulfurization and oxidative desulfurization. In this process, the reduced sulfur stream was obtained by carrying out the hydrodesulfurizion of initial hydrocarbon feed stream. Hydrotreated stream is fed to oxidation reaction zone along with oxidizing agent and catalyst to oxidize the residual sulfur compound to their corresponding sulfones. Oxidized sulfur compounds are removed in one stream and oxidized sulfur compounds lean hydrocarbon stream is recovered in second stream.

Wittenbricnk et al. U.S. Pat. No. 6,087,544 discloses a process for the production of high lubricity low sulfur distillate fuels. Feed stream is first fractionated into a light fraction containing from 50 to 100 ppmw of sulfur, and a heavy fraction. The light fraction is passed to a hydrodesulfurization reaction zone. Part of the desulfurized light fraction is blended with the certain part of heavy fraction to produce a low sulfur distillate fuel to meet the sulfur specification of 500 ppmw and lubricity requirement. It does not disclose further treatment of remaining heavy fraction of gas oil which is not blended with hydrodesulfurized light fraction.

Rappas et al. PCT publication WO 02/18581 discloses a process in which feed stock is hydrotreated in hydrodesulphurization reaction zone in presence catalyst and hydrogen. The entire hydrotreated stream is subjected to oxidation reaction zone which utilizes the hydrogen peroxide and formic acid to oxide the sulfur compounds. The stream, containing oxidized sulfur compounds, is further subjected to liquid-liquid extraction to remove the sulfones and to generate the hydrocarbon stream containing reduced sulfur level.

Levy et al. PCT application WO 03/014266 describes a process in which hydrocarbon stream is fed to oxidation reaction zone to convert the sulfur compounds into their corresponding sulfones using an aqueous oxidizing agent. After separating the oil phase of oxidation mixture, it is subjected to hydrodesulphurization.

Gong et al. U.S. Pat. No. 6,827,845 describes a process in which entire petroleum distillate is subjected to hydrodesulphurization reactor in presence of hydrogen and catalyst. After separating the hydrotreated oil from hydrogen and other lighter gas, it is fractionated in two fractions. The lighter fraction is either subjected to oxidation or blended with the stream obtained from oxidative desulfurization of heavy fraction. Heavy fraction of hydrotreated stream is subjected to oxidation reaction zone free from catalytically active metals using the peracids. The process requires very high$H_2O_2$: S molar ratio; in one of the example is 640 which is extremely high as compared to oxidative desulfurization with a catalytic system.

Gong et al U.S. Pat. No. 7,252,756 discloses a process for preparation of components for refinery blending of transportation fuels having a reduced amount of sulfur and/or nitrogen-containing impurities. In the process, a hydrocarbon feedstock containing the above impurities is contacted with an immiscible phase containing hydrogen peroxide and acetic acid in an oxidation zone. The hydrocarbon phase from aqueous phase is separated using the gravity principle. Then, this phase is passed to an extraction zone wherein aqueous acetic acid is used to extract a portion of any remaining oxidized impurities. A hydrocarbon stream having a reduced amount of sulfur and/or nitrogen-containing impurities is recovered. The acetic acid phase effluents from the oxidation and the extraction zones were routed to a common separation zone for recovery of the acetic acid. The recovered acetic acid is optionally recycled back to the oxidation and extraction zones.

Koseoglu et al., EP 2652089 A2, Pub. No. U.S. 2012/0145599A discloses an integrated process for desulfurization and denitrification. In the process first, entire hydrocarbon feed is hydrotreated to produces a hydrotreated effluent with lower content of labile organosulfur compounds. Thereafter, entire hydrotreated effluent is subjected to an extraction zone to produce an extract and raffinate. Extract contains major proportion of the aromatic content of the hydrotreated effluent and a portion of the extraction solvent. Raffinate contains a major proportion of the non-aromatic content of the hydrotreated effluent and a portion of the extraction solvent. Solvent removal from both extract and raffinate phases are proposed using flashing or striping or suitable apparatus. Solvent free aromatic-rich fraction extract is subjected to oxidation zone in presence of oxidizing agent and metal catalyst. Oxidized sulfur compounds were removed from oxidized aromatic rich extract using solvent extraction and adsorption to make final aromatic fraction with 10 ppmw sulfur.

Koseoglu et al. U.S. Pat. No. 8,741,128B2 discloses an integrated desulfurization and denitrification processes which includes mild hydrotreating of aromatic lean fraction and oxidation of aromatic rich fraction. In this process entire hydrocarbon feed stock is subjected to solvent extraction. The sulfur and aromatic lean hydrocarbon stream from extraction zone along with hydrogen is subjected to hydrodesulfurization reaction zone containing metal catalyst. The aromatic and refractive sulfur compound containing stream from extraction zone is subjected to oxidation reaction zone with an oxidizing agent and metal catalyst. The oxidized aromatic and sulfur rich stream is subjected to liquid—liquid extraction to remove oxidized sulfur compounds and finally the hydrocarbon stream containing reduced level of aromatics and sulfur is subjected to adsorption to meet the sulfur specification of 10 ppmw. However, after mixing the both fractions (raffinate from extraction zone and oxidation zone), sulfur in final product is in the range of 40-50 ppmw.

The person of ordinary skill in the art can understand that above references do not disclose a suitable and cost effective process required for deep desulfurization of gas oil. Most of the conventional processes do not target the different classes of sulfur and aromatic compounds having significant different relative reactivity to the conditions of hydrodesulphurization for minimizing the severity of hydrotreating reaction zone and for reducing the operational and equipment capital cost. In the conventional processes disclosed in prior art entire feed stream is subjected either to solvent extraction or hydrodesulphurization or oxidative desulfurization or adsorptive desulfurization or their combination for deep removal of sulfur compounds. This results the size of unit operations involved in the process dimensioned to the entire flow of feed. Process disclosed in the U.S. Pat. No. 8,741,128B2 and EP 2652089 A2 try to attempt the management of the different classes of sulfur compounds for making the desulfurization process more cost effective. However, in these processes also entire gas oil stream was subjected to solvent extraction process to generate the aromatic, sulfur and nitrogen compounds rich and lean hydrocarbon fractions of gas oil. Further, only the aromatic rich fraction of gas oil is subjected to oxidation zone to reduce the size of oxidation reaction zone and associated separations units such as solvent extraction and adsorption.

Person of the ordinary skilled in the art can understand that infrastructure and operational economics of the oxidative based process in refinery does not seems good due to various reasons; need of new facilities installation for generation of oxidants; installation of number of equipment for separation of unconverted oxidants, water, homogeneous catalyst using either distillation or some other methods, separation of oxidized sulfur compounds from non-sulfur compounds using either solvent extraction which needs extraction and solvent recovery facilities or adsorption which needs adsorption and regeneration facilities or combination of both. Generally, oxidant to sulfur molar ratio of greater than 4 is required in oxidative desulfurization, therefore for high sulfur stream the amount of oxidant will be huge. Thus, it seems evident from above discussion that savings in oxidative desulfurization based process due to less sever operating conditions and no hydrogen requirement would be watered down due to need of expensive oxidants, catalyst and number of new equipment for oxidation, separation of components of oxidized stream and separation of oxidized sulfur compounds.

Moreover, in the disclosed prior arts wherein entire hydrocarbon stream having boiling range of 170-400° C. subjected to solvent extraction and oxidative zone of the process shall lead to capital intensive process with huge operating cost and energy requirement. Person of the ordinary skilled in the art can understand that economics of extraction and oxidative desulfurization using solvent extraction for sulfones removal greatly depends on the nature of solvent used. Solvent recovery for its reuse from extract and raffinate phase is essential in extractive and oxidative based processes as solvent is far expensive than gas oil and its presence will affect the secondary process to be used for gas oil utilization. The simplest and most economical design of solvent recovery section is based on distillation and striping. However, person of the ordinary skilled in the art can understand that for utilization of this simple design, there should be temperature difference of at least 50-80° C. between boiling point of solvent and initial boiling point of feed to recover solvent from extract and raffinate phases. For lower temperature difference significant amount of hydrocarbon will contaminate the recovered solvent to achieve the target of trace amount of solvent in extract hydrocarbons. Thus, for treating the entire hydrocarbon stream having boiling range of 170-400° C. in extraction and oxidation with using simple distillation based solvent recovery, only low boiling solvents polar solvents such as methanol, ethanol, acetonitrile have to be used. However, it is reported in literature that sulfur and aromatic removal efficiency of these solvent is very poor (Otsuki, S., Nonaka, T., Takashima, N., Qian, W., Ishihara, A., Imai, T., Kabe, T. Oxidative desulfurization of light gas oil and vacuum gas oil by oxidation and solvent extraction. Energy Fuels. 2000; 14:1232-1239). Thus, application of these solvent need very high solvent to feed ratio which will result in significant increase in size of extraction unit and huge energy requirement to vaporize that huge quantity of solvent. Moreover, suitable and industrial proven solvents such as furfural, N-methyl 2-pyrrolidone, dimethylformamide and dimethylsulfoxide for sulfur and aromatic removals have high boiling point. Thus, application of these solvent in solvent extraction and oxidative desulfurization need a complicated design of solvent recovery wherein dissolved hydrocarbon in solvent (extract phase) can be recovered using secondary light boiling hydrocarbon solvent in subsequent extractor unit. Thereafter, secondary solvent can be recovered using distillation and striping. The design of solvent recovery sections needs more number of equipment and significant higher energy requirement compared to simple distillation and striping based design. Moreover, subjecting the entire middle distillate to the extraction process will not only need high operating cost but also lead significant loss of desired hydrocarbon with extract phase. Moreover, person skilled in the art can understand that in case of oxidized stream containing very high aromatics as 80% reported in Koseoglu et al., EP 2652089 A2, the yield of raffinate obtained from extraction of oxidized hydrocarbon will be lower and would not be also very lean in aromatics compounds.

In view of above, there is a need to develop a cost effective and energy efficient process which can overcome the disadvantages of processes disclosed in prior art for desulfurization of gas oil. The present invention is to provide an integrated process to overcoming the problems set forth above and to provide a cost effective, easy to retrofitting in existing hydrotreating process in refineries for removal of sulfur and di & poly aromatic compounds from gas oil.

OBJECTIVE OF THE INVENTION

The main object of the present invention is to provide an integrated process for simultaneous removal and value addition to the sulfur and aromatics compounds of gas oil which obviates the drawbacks of hitherto known methods as detailed above.

Another object of the present invention is to provide an integrated process for simultaneous removal and value addition to the sulfur and aromatics compounds of gas oil via innovative and energy efficient management of different sulfur compounds having much different hydrodesulphurization relative reactivity and aromatic compounds works as inhibitors in hydrodesulphurization reactions to make the process cost effective and environment friendly.

Still another object of the present invention is segregating the refractive sulfur compounds (Alkyl substituted dibenzothiophes and debenzonapthiophene) and polyaromatics compounds which acts as inhibitors in hydrodesulphurization in heavy fraction of gas oil using the salient feature of volatility based separation in distillation.

Yet another object of the present invention is to reduce the huge operating and investment cost of extraction process to be used for separation of sulfur and aromatic compounds from non-sulfur and non-aromatic compounds by processing of the heavy fraction of gas oil only due to its significantly reduced flow rate in comparison to full range gas oil.

Yet another object of the present invention is to enhance the performance of solvent extraction process for easy separation of polyaromatics and refractive sulfur compounds due to enhanced solubility difference between undesired refractive sulfur and polyaromatics compounds and desired saturates and aromatics in heavy fraction of gas oil compared to full range gas oil.

Yet another object of the present invention is to avoid the need of solvent extraction of lighter fraction of gas oil which is lean in refractive sulfur compounds and polyaromatics compounds. Yet another object of the present invention is to provide the flexibility for selection of the suitable polar solvents having the boiling point below 220° C. with an economical and easy to operate option of solvent recovery using the distillation and striping.

Yet another object of the present invention is to enhance the temperature difference between solvent boiling point and initial boiling point (IBP) of feed for easy and economic solvent recovery from extract phase with minimum energy requirement, minimum loss of solvent in extract and minimum contamination of recovered solvent with extract hydrocarbon carryover using distillation and striping.

Yet another object of the present invention is to provide an economical integrated process for enhancing the cetane number of hydrotreated gas oil by removal of di and polyaromatics compounds which have very low cetane number along with refractive sulfur compounds from feed to hydrotreating zone without increasing the severity of operating conditions as required in conventional hydrodesulphurization process to convert them in monoaromtaics.

Yet another object of the present invention is to generate the pseudo raffinate from the extract phase obtained from solvent extraction of heavy fraction of gas oil to generate the suitable feed consisting of minor portion of gas oil for existing secondary conversion processes such as either hydrocracker to generate the lower sulfur gas oil and to improve the quality of extract hydrocarbon so as to use as a carbon black feed stock.

Yet another object of the present invention is to recycle one part of pseudo raffinate to continuous counter current extraction column to minimize the loss of desired martial with extract hydrocarbon.

SUMMARY OF THE INVENTION

Accordingly, the present invention provides an integrated process for simultaneous removal and value addition to the sulfur and aromatics compounds of gas oil comprising the steps of:

i. distilling gas oil under vacuum or positive pressure in the range of 40-2280 mmHg temperature in the range 100-350° C. to obtain the refractive sulfur and polyaromatics lean lighter fraction of gas oil (LFGO), refractive sulfur and polyaromatics rich heavy fraction (HFGO) of gas oil;

ii. distilling gas oil under vacuum or positive pressure in the range of 40-2280 mmHg temperature in the range 100-350° C. to obtain the refractive sulfur and polyaromatics lean lighter fraction of gas oil (LFGO), refractive sulfur and polyaromatics rich heavy fraction (HFGO) of gas oil;

iii. mixing HFGO as obtained in step (i) with polar solvent in continuous extraction column at a temperature in the range of 30 to 70° C. with solvent to feed ratio in the range of 0.5 to 4.0. to obtain a raffinate lean in refractive sulfur and polyaromatics and extract rich in refractive sulfur and polyaromatics compounds;

iv. washing the raffinate as obtained in step (ii) with water for removing the small amount of solvent;

v. mixing the extract as obtained in step (ii) to anti-solvent in single stage mixture settler, to obtain the pseudo raffinate (PSR) hydrocarbon and extract containing enhanced concentration of sulfur and aromatic compounds;

vi. subjecting the solvent rich extract phase obtained in step (iv) and water containing small amount of solvent obtained from wash zones obtained in step (iii) to solvent recovery column for recovery of aqueous solvent and extract hydrocarbon stream;

vii. distilling the aqueous solvent as obtained in step (v) to separate water and dry solvent with water concentration in the range of 0.0 to 10.0% for its reuse in the process;

viii. subjecting some fraction of pseudo raffinate (PSR) as obtained in step (iv) in the range of 5 to 50% to continuous extraction column to improve the yield of raffinate;

ix. subjecting major portion of pseudo raffinate (PSR) as obtained in step (iv) in the range of 50 to 95% to hydrocracker to obtain gas oil of reduced sulfur and aromatics level;

x. routing of extract hydrocarbon stream obtained in step (v) as a sustainable feed stock to carbon black generation unit to produce carbon or delayed cocker unit to obtain reduced sulfur products;

xi. hydrotreating refractive sulfur and polyaromatics lean lighter fraction of gas oil (LFGO) as obtained in step (i) and/or solvent free raffinate in presence of hydrogen and metallic catalyst to reduce sulfur and aromatics in gas oil;

xii. blending of the desulfurized gas oil having sulfur less than 75 ppmw obtained in step (x) with gas oil having sulfur less than 10 ppmw obtained in step (viii) to produce low sulfur gas oil wherein the sulfur in desulfurized gas oil is less than 70 ppmw.

In an embodiment of present invention, the gas oil used in step (i) containing the monoromatic compounds in the range of 10-20 wt %, diaromatics compounds in the range of 10-30 wt % polyaromatics compounds in the range of 3-25 wt %; nonaromatic compounds in the range of 35-80% and sulfur content in the range of 0.2 to 4.0 wt %.

In another embodiment of present invention, the volume of lighter fraction of full range gas oil is in the range of 30 to 80% of gas oil, preferably in the range of 40 to 70%, most preferably in the range of 50 to 60%.

In yet another embodiment of present invention, polar solvent used in step (ii) is selected from a group consisting of N dimethyl formamide (DMF), N dimethyl acetamide (DMA), N methyl 2 pyrilidone (NMP), furfural, ethylene glycol, diethylene glycol, acetonitrile in combination with and without water and combination thereof.

In yet another embodiment of present invention, solvent removal in step (iii) from raffinate and pseudo raffinate can alternately be obtained by either water washing or distillation or stripping or combination thereof.

In yet another embodiment of present invention, the anti-solvent used in step (iv) is selected from water, methanol, ethanol, propanol.

In still another embodiment, the present invention reduces loss of paraffin and monoaromtaics compounds with extract hydrocarbons and facilitates complete solvent recovery from extract and raffinate phase using simple distillation and striping based method.

In still another embodiment of present invention, the mixture settler operates with the ratio of extract and water in the range of 100:5, preferably in the range of 80:10 and most preferably in the range of 40:15 and temperature in the range of 30 to 70° C. to obtain the pseudo raffinate and extract hydrocarbon of desired purity.

In still another embodiment of present invention, hydrotreating reaction is operated under mild reaction condition with a reactor pressure in the range of 20 bar to 40 bar, reactor temperature in the range of 300 to 400° C. with weight hour space velocity of feed in the range of 0.5 to 3.0 $h^{-1}$ in presence of metallic hydrotreating catalyst.

In still another embodiment, the present invention provides further comprising the clean feed lean in refractive sulfur, di and poly aromatics compounds to hydrotreating zone for reducing the chemical hydrogen consumption for sulfur and aromatics removal from gas oil by 30 to 80%.

In still another embodiment of present invention, the sulfur content in desulfurized gas oil is less than 70 ppmw.

In still another embodiment of present invention, extract hydrocarbon as obtained in step (v) is of improved quality can be used as feed stock either in carbon black generation unit or in delayed cocker unit.

Figure 1:
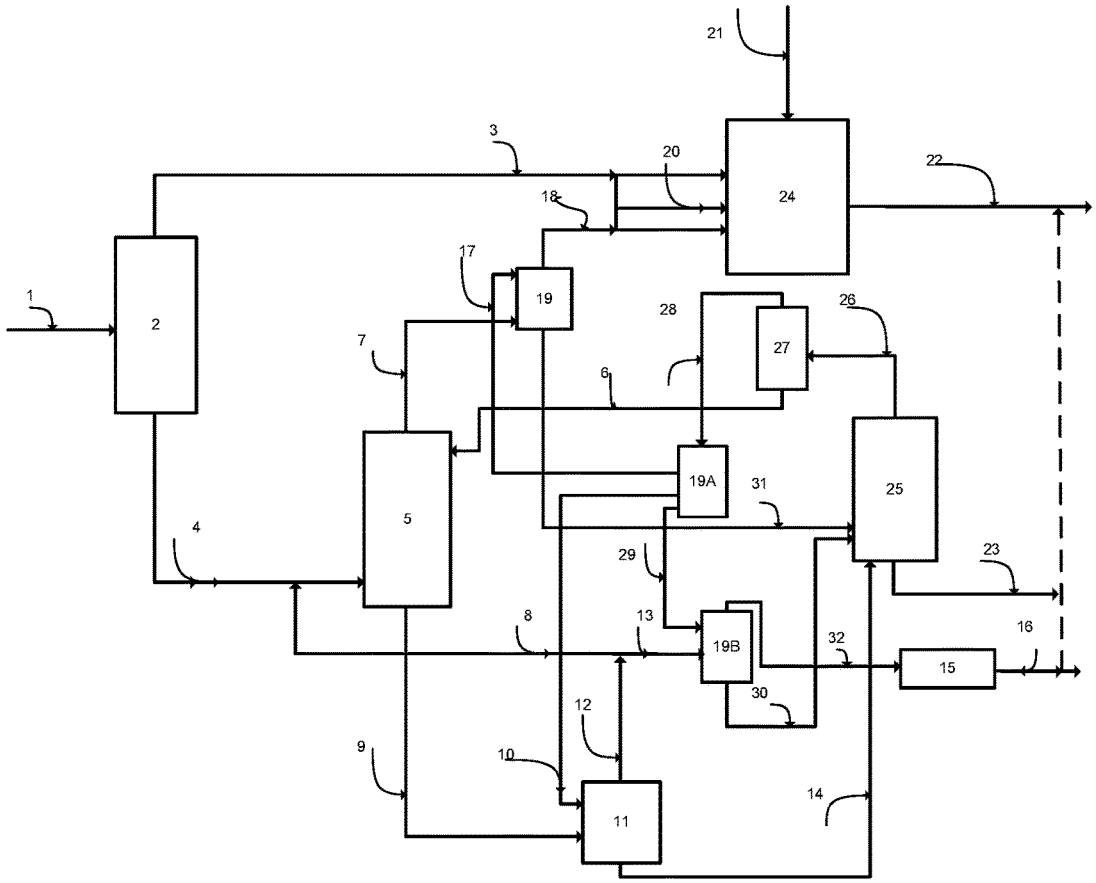
FIG. 1 depicts a systematic representation of the integrated process for simultaneous removal and value addition to the sulfur and aromatics compounds of gas oil to meet the objectives of present invention consists of the steps.

The gas oil stream 1 containing the monoromatic compounds in the range of 10-20 wt %, diaromatics compounds in the range of 10-30 wt % polyaromatics compounds in the range of 3-20 wt %; nonaromatic compounds in the range of 35-80% and sulfur content in the range of 0.2 to 4.0 wt % is subjected to the distillation zone 2 to obtain the refractive sulfur and polyaromatics lean lighter fraction of gas oil 3 and refractive sulfur and polyaromatics rich heavy fraction of gas oil 4.

The heavier fraction of gas oil (HFGO) 4 is contacted with polar solvent stream 6 in extraction column 5 for removal of the refractive sulfur and polyaromatics compounds and obtaining the raffinate phase 7 lean in refractive sulfur and polyaromatics and extract phase 9 rich in refractive sulfur and polyaromatics compounds.

The raffinate phase 7 is subjected to water washing zone for removing the small quantity of solvent for generating the refractive sulfur and polyaromatics lean hydrocarbon stream 18.

The extract phase 9 is contacted to certain amount of water stream 10 in single stage mixture settler 11 to generate the pseudo raffinate (PsR) hydrocarbon stream 12 and extract phase 14 containing enhanced concentration of sulfur and di and polyaromatic compounds.

The extract phase 14 and water containing small amount of solvent streams 30 and 31 are subjected to the solvent recovery column 25 for recovery of aqueous solvent and extract hydrocarbon from this solvent rich stream.

The recovered aqueous solvent 26 is subjected to distillation zone 27 to separate water 28 and dry solvent or solvent with desired water concentration stream 6 for its reuse in the process. Some portion of pseudo raffinate hydrocarbon stream 12 as stream 8 is recycled to the continuous extraction column 5.

The extract hydrocarbon stream 23 is routed to carbon black generation unit or delayed cocker unit and stream 13, one part of pseudo raffinate stream 12 are routed to the solvent recovery or washing zone 19B to generate stream 32 to be used as feed to existing hydrocracker 15 or fluidized catalytic cracker in refinery.

The refractive sulfur and polyaromatics lean lighter fraction of gas oil 3 or refractive sulfur and polyaromatics lean raffinate hydrocarbon stream 18 or streams 20 made by mixing of stream 3 and 18 in the ratio of ranging from 4 to 1 are subjected to the hydrotreating reaction zone 24 containing hydrotreating metallic catalyst along with hydrogen stream 21 to generated gas oil with reduced sulfur and aromatic concentration level.

The desulfurized gas oil stream 22 and gas oil stream 15 16 from hydrocracker 15 are blended to produce low sulfur gas oil.

Figure 2A:
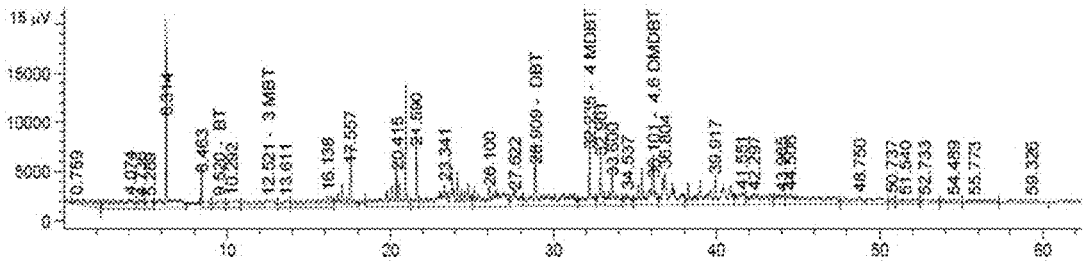
Figure 2B:
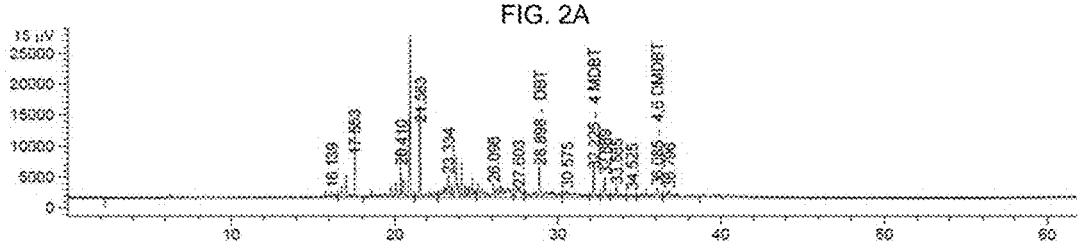
Figure 2C:
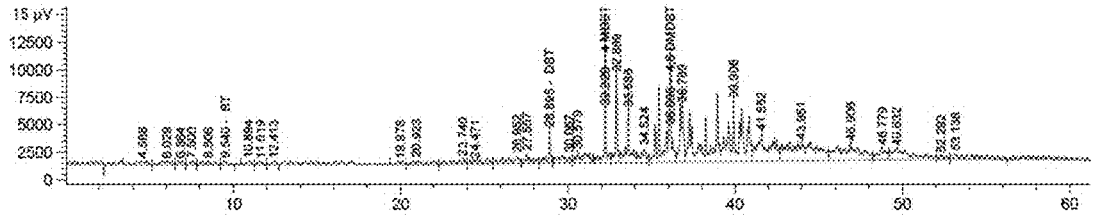

FIGS. 2A-2C depict representation of pulsed flame photometric detector (PFPD) spectra's showing sulfur type specification of gas oil, lighter fraction of gas oil and heavy fraction of gas oil.

DETAILED DESCRIPTION OF THE INVENTION

As used herein, the term "polyaromatics" means it includes all the aromatics compounds having more than two aromatic rings. To meet the objectives of present invention, the integrated process of present invention consists of the following steps:

a) subjecting the gas oil to distillation zone to obtain the refractive sulfur and polyaromatics lean lighter and refractive sulfur and polyaromatics rich heavy fraction of gas oil;
b) contacting the heavy fraction of gas oil (HFGO) with polar solvent in continuous extraction column for generating the raffinate phase lean in refractive sulfur and polyaromatics and extract phase rich in refractive sulfur and polyaromatics compounds;
c) subjecting the raffinate phase to water washing or distillation or striping zone for removing the small amount of solvent;
d) contacting the extract phase to certain amount of anti-solvent such as water in single stage mixture settler, to generate the pseudo raffinate (PSR) hydrocarbon stream and extract phase containing enhanced concentration of sulfur and aromatic compounds;
e) subjecting the solvent rich extract phase obtained in step d and water containing small amount of solvent obtained from wash zones obtained in step c to solvent recovery column for recovery of solvent and extract hydrocarbon stream;
f) subjecting the recovered aqueous solvent in step e to distillation column to separate water and dry solvent or solvent with desired water concentration for its reuse in the process;
g) recycling of one part (5-50%) of pseudo raffinate in the continuous extraction column to improve the yield of raffinate;
h) routing of the one part (50-95%) of pseudo raffinate to the existing hydrocracker for generating the gas oil of much reduced sulfur and aromatics level;
i) routing of extract hydrocarbon stream obtained in step e) as a sustainable feed stock to carbon black generation unit or delayed cocker unit;
j) subjecting refractive sulfur and polyaromatics lean lighter fraction of gas oil (LFGO) or solvent free raffinate or their mixture to the hydrotreating reaction zone in presence of hydrogen and metallic catalyst;
k) blending of the desulfurized gas oil obtained from hydrotreating reaction zone and hydrocracker to produce low sulfur gas oil.

A cost effective integrated desulfurization process of present invention is graphically illustrated in FIG. 1. Gas oil stream 1, is introduced in the distillation zone 2 to generate light fraction of gas oil stream 3 lean in refractive sulfur and polyaromatics and heavy fraction of gas oil stream 4 rich in refractive sulfur and polyaromatics. Stream 4 contains major portion of refractive sulfur compounds and polyaromatics of the initial feed stream 1, whereas, stream 3 contains minor portion of the refractive sulfur and polyaromatics of feed stream 1.

The degree of partition of refractive sulfur compound and polyaromatics compounds in stream 3 and 4 in distillation zone will depends on the operating conditions such as temperature and pressure, reflux ratio used in the distillation zone and hardware of distillation zone such as number of tray, their efficiency etc. Stream 3 lean in refractive sulfur and polyaromatics compounds represents a portion of feed in the range of 50-70 volume % and stream 4 rich in refractive sulfur and polyaromatics compounds represent the a portion of feed in the range of 30-50 volume % feed.

In the present invention, only stream 4 which flow rate is in the range of 30-50 volume % of initial feed is subjected to extraction zone 5 to overcome the disadvantage of prior art processes of huge capital and operating cost requirement due to processing of entire feed stream to the extraction zone. Polar solvent stream 6 is contacted with stream 4 in extraction zone 5 consists of jacketed packed bed column operating in continuous counter current fashion using the extraction temperature in the range of 40-70° C. and solvent to feed ratio in the range of 0.5 to 4.0 (volume/volume). The raffinate phase stream 7 lean in refractive sulfur and polyaromatics and extract phase stream 9 rich in refractive sulfur and polyaromatics are obtained from the extraction zone 5. Raffinate phase stream 7 is further subjected to raffinate solvent recovery zone 19 which may be either water washing or distillation or striping. In case when 19 represent water washing zone to remove the small quantity of solvent uses water stream 17 to remove solvent from raffinate phase. The water and solvent mixture stream 31 from washing zone 19 is routed to solvent recovery zone 25. Solvent free raffinate stream 18 obtained from washing zone 19 is lean in refractive sulfur and polyaromatics. The extract phase stream 9 was further subjected to anti-solvent such as water stream 10 in single stage mixture settler zone 11 to generate the pseudo raffinate stream 12 to increase the aromatic concentration in extract phase stream 14 for its value addition so as it can be used as feed stock to carbon black production process or delayed Coker.

Further, it is easy to understand that concentration of carbon content will be higher in aromatics compared to other compounds present in the extract stream obtained from extraction process. The carbon concentration in gas oil compounds increases with increase in its aromaticity. In distillate having boiling range above around 320° C., aromaticity of aromatic compounds will increase in order; monoaromtaics<diaromatics<polyaromatics. In practice, quality of carbon black feed stock is characterized by its Bureau of Mines Correlation Index (BMCI) value which is a linear function of density and inverse function of average boiling point of feed. It is to be noted that density of di and polyaromatics in extract phase would be much higher than the other compounds due to association of long paraffinic chain with other compounds. Thus, higher density of extract phase implies higher concentration of aromatics compounds and higher value of BMCI. The increase in BMCI value of carbon black feed stock indicates the improvement in its quality.

The recycle stream 8 consist of one part of pseudo raffinate stream 12 in the extraction zone 5 will enhance the yield of raffinate phase stream 6 without affecting the concentration of refractive sulfur and polyaromatics compounds in stream 18 just by adjusting and fine tuning of the extraction column operating conditions. The stream 13, other part of pseudo raffinate stream 12, having the flow rate in range of 4-12% of gas oil is subjected to solvent removal zone 19B which may consists of water washing or distillation or stripping. In case when zone 19B represents water washing zone, it uses the water stream 29 to remove solvent from pseudo raffinate. The solvent free pseudo raffinate stream 32 can be routed to existing hydrocracker 15 designed to be operated at sever operating condition to process the difficult feed such as vacuum gas oils, to obtain sulfur free gas oil stream 16 which can be blended with the desulfurized gas oil stream 22. Solvent and water mixture stream 30 from washing zone 19B and extract phase stream 14 from the single stage mixture settler 11 are routed to solvent recovery column 25 for recovery of solvent for its reuse in process and extract hydrocarbon rich in refractive sulfur and polyaromatics compounds to be used carbon black feedstock or feedstock to cocker. Water and solvent mixture obtained from the top of solvent recovery column 25 is introduced in distillation column 27 to separate the water and solvent. Water stream 28 is used in wash zones 19 and 19B and in single stage mixture settler 11 as water streams 17, 29 and 10, respectively through the surge drum 19A.

Light fraction of gas oil stream 3 or raffinate stream 18 or mixture of these two streams 20 containing minor portion of refractive sulfur and polyaromatics compounds are introduced in the hydrotreating zone 24 in presence of hydrotreating metallic catalyst and hydrogen stream 21 to produce the gas oil stream 22 with reduced sulfur and aromatics level. The hydrodesulphurization zone is operated under mild reaction conditions of temperature in the range of about 250 to 400° C. and pressure of about 20-50 bars.

As used herein, the term "major portion of/rich in refractive sulfur and polyaromatics compounds" means that the concentration of refractive sulfur and polyaromatics in the stream is at least more than 45% of the feed, preferably at least more than 80% of the feed. The term used herein "minor portion of/lean in refractive sulfur and polyaromatics compounds" means that concentration of refractive sulfur and polyaromatics in stream is at least less than 50 wt % of the feed, preferably at least less than 40 wt % of the feed. As used herein, the term "refractive sulfur compounds" means sulfur compounds includes alkyl substituted dibenzothiophene and benzonaphthaothiophene". As used herein, the term "raffinate phase" means the stream obtained in the solvent extraction zone rich in hydrocarbon. As used herein, the term "extract phase" means the stream obtained in the solvent extraction zone rich in solvent. As used herein, the term "extract hydrocarbon" means the hydrocarbon obtained from the extract phase after solvent removal. As used herein, the term "pseudo raffinate" means the hydrocarbon rich stream obtained on mixing the anti-solvent in the extract phase obtained from continuous extraction of heavy fraction of gas oil.

The operational and capital cost of the equipment, for solvent extraction depends on the operating conditions such as extraction temperature, pressure, and solvent to feed ratio, amount of feed to be processed and type of solvent used whereas, for hydrotreating depends on amount of feed to be processed and severity of operating conditions which consequently will depend on the concentration of refractive sulfur, di & poly aromatics and nitrogen compounds in the feed and extent of sulfur removal.

The solvent extraction process, economic recovery of solvent from extract hydrocarbon is only possible using simple distillation and striping based design of solvent recovery zone. However, application of distillation based solvent recovery needs significant temperature difference between solvent boiling point and initial boiling point of feed to be processed in extraction zone. Therefore, solvent extraction of full range gas oil (170-400° C.) restricts the selection of the solvent to the limited solvents having lower boiling point and restrict the use of most widely used in industry and stable solvents like N-Methyl-2-pyrrolidone (NMP), furfural, etc. It is reported that lower boiling point solvent are not effective for sulfur removal from gas oil boiling range hydrocarbon stream. In case of using the N-Methyl-2-pyrrolidone as solvent for extraction of full range gas oil, its recovery from extract phase will require the complex and expensive design of solvent recovery section such as extraction using secondary solvents which will further add the cost to the process.

In the process of present invention only heavy fraction of gas oil is subjected to extraction zone. Drastic reduction in the feed flow rate to the extraction zone reduces the energy and size of extraction zone significantly. High initial boiling point (IBP) of heavy fraction of gas oil provide the opportunity to use any suitable solvent of having the boiling point less than about 220° C. with the provision of simple and economical solvent recovery using distillation and striping method. Thus in the process of present invention solvent can be fully recovered from raffinate and extract hydrocarbon for its reuse in the process in a very economical and energy efficient way. Further, though present invention uses the distillation step for fractionation of gas oil, however, during the implementation of this invention in actual refinery, provision for generating light and heavy fractions of gas oil can be made easily in distillation column used for its separation from other hydrocarbon streams by optimizing and fine tuning of operating conditions (temperature and pressure). Thereby, implementation of invention may not need distillation step also. Integrated process of present invention also reduce loss of paraffin and monoaromtaics with extract phase as happened in prior art process wherein entire feed is subjected to solvent extraction. Reduction in loss is achieved as heavy fraction consisting of less than 50% of feed is only subjected to extraction and paraffin and monoaromtaics compounds solubility in polar solvent decreased with an increase in their boiling temperature.

Generally non-refractive sulfur compounds (DBT and lower sulfur compounds) followed hydrogenolysis pathways for sulfur removal in the form of $H_2S$. Whereas refractive sulfur compounds followed the hydrogenation pathways in which first aromatic ring associated to sulfur saturates then sulfur is removed as $H_2S$. It clearly suggest that hydrogen consumption will be significantly higher for removing the sulfur from sulfur compounds which follow hydrogenation pathways than removing sulfur from sulfur compounds which follow hydrogenolysis pathways. Saturation of polyaromatics also takes place during the sulfur removal from refractive sulfur compounds that further enhance the consumption of hydrogen. In the present invention, the streams to be treated in desulfurization zone are lean in total sulfur, refractive sulfur compounds and polyaromatics. This will leads to significant reduction in hydrogen consumption and reduced $H_2S$ in recycled hydrogen. Accordingly, integrated process of the present invention provide the opportunity to save huge investment required for retrofitting of existing facilities which requires either new equipment or revamp of existing equipment such as makeup compressor due to significant increase in hydrogen consumption, recycle gas compressor due to increased recycle gas flow and pressure drop, vessels due to hydraulic issues, and the amine treating unit for the treating the additional gas rate for deep desulfurization of gas oil compared to standalone hydrotreating at sever operating conditions. Moreover, invention can also eliminates the need of either revamp of existing hydrogen generation plant or setting up the new grass root hydrogen generation plant (which is very capital intensive) as it will be required to meet the significantly increased hydrogen consumption in high severity operation of hydrotreating reactor for deep sulfur, di and poly aromatic removal from untreated gas oil using the process of integrated process of present invention.

The present invention provides an economic integrated process wherein di and polyaromatics compounds along with refractive sulfur compounds from heavy fraction of gas oil are removed using solvent extraction. The raffinate lean in di and poly aromatics compounds which have very low cetane number is feed to hydrotreating zone. This result in enhanced cetane number of hydrotreated gas oil without requirement of increase in severity of operating conditions in hydrotreater as it would be required in conventional single step hydrotreating process to convert significant portion of polyaromatics into monoaromtaics to enhance cetane number.

The processes other than hydrotreating used in present integrated process allow the partition of different type of sulfur and aromatic compounds to their respective reactivity factors in hydrodesulphurization. Novelty of invention also relies in providing the method and process for noteworthy improvement in removal efficiency of sulfur from gas oil in hydrotreater operated at relatively mild temperature and pressure conditions confirming to the design capability of existing one in the refinery. Thus, present inventions makes use of innovative management of different sulfur compounds of different reactivity, polyaromatics which are strong desulfurization reaction inhibitors and saturates compounds for making the integrated process for desulfurization of gas oil of present invention cost effective, less energy intensive and environmental friendly.

Present invention gives a methodology for value addition of sulfur and polyaromatics compounds by concentrating these compounds in extract phase hydrocarbon using solvent extraction and pseudo raffinate generation so that these compounds can be used as a suitable carbon black feed stock (CBFS) for carbon black generation. The cost of carbon black feed stock to be used for carbon black production and gas oil to be used in transport are comparable. Thus, present invention adds value to polyaromatics and refractive sulfur compounds in a very cost effective way.

Innovation integrated process of present invention also has the full flexibility in term of optimizing the quantity of light and heavy fraction of gas oil, raffinate from heavy fraction of gas oil, feed stock to existing hydrocracker and extract hydrocarbon to be used as CBFS. More process has flexibility in term of improving the quality of these streams to meet the requirement of downstream units to be used for their processing by adjusting and fine tuning the operating conditions of distillation, extraction and pseudo raffinate generation zone.

Moreover, integrated process of present invention is easy to implement in actual industry due to simplified and compact design of solvent extraction zone, no need of oxidation zone and very high chances to eliminating the need of new distillation column for generating light and heavy fractions of gas oil by making provision in exited distillation column used for its separation from other hydrocarbon streams by optimizing and fine tuning of column's operating conditions (temperature and pressure).

EXAMPLES

Following examples are given by way of illustration and therefore should not be construed to limit the scope of the invention.

The studies were carried out using the gas oil obtained from an Indian refinery and its characterization is given in Table 2. PFPD spectra indicating sulfur specification of gas oil generated using PFPD inbuilt GC is given in FIG. 2.

TABLE 2

| Physico-Chemical Properties of Gas Oil | |
|---|---|
| Parameter | Value |
| Total sulfur, wt % | 1.36 |
| Mono-aromatics, wt % | 13.9 |
| Diaromatics, wt % | 10.0 |
| Polyaromatics, wt % | 5.5 |
| Non aromatics, wt % | 70.6 |
| Refractive Index nd20 at 20° C. | 1.4727 |
| Density at 20° C. g/cc | 0.85184 |
| Kinematic viscosity at 70° C., cst | 2.18 |
| Kinematic viscosity at 100° C., cst | 1.44 |
| Moisture, ppmw | 1,476 |
| Metal | |
| Vanadium, mg/L | <1.0 |
| Nickel, mg/L | <1.0 |
| Fe, mg/L | 1.29 |

| Distillation Range- ASTM D86 | |
|---|---|
| Volume % | Temperature ° C. |
| IBP | 236.5 |
| 5 | 257.5 |
| 10 | 266.7 |
| 20 | 277.1 |
| 30 | 285.2 |
| 40 | 295.1 |
| 50 | 305.1 |
| 60 | 317.0 |
| 70 | 330.3 |
| 80 | 346.4 |
| 90 | 366.2 |
| 95 | 383.5 |
| FBP | 386.7 |

In present invention, alkyl substituted dibenzothiophene, and benzonaphthaothiophene sulfur compounds are grouped to represent the refractive sulfur compounds as these remain unconverted under mild conditions of hydrotreating reaction. Sulfur specification of the gas oil carried out by PFPD inbuilt GC shown in PFPD spectra's above indicates that 55.7% of sulfur compounds are up to the dibenzothiophene (DBT) and 44.3% are beyond dibenzothiophene which includes dibenzothiophene and benzonaphthaothiophene with alkyl substituents. The percent distribution of sulfur compounds was estimated using relative peak areas.

Example 1

The gas oil (characterization given in Table 2) was taken in 10 liter round bottom flask. Slow heating adjusted by rheostats was provided to round bottom flask to remove the lighter fraction drop by drop. Initially, the separation was carried out under atmospheric pressure then vacuum of 635 mm Hg (125 mmHg absolute) was used to facilities the removal of lighter fraction at lower temperature. The lighter fraction of gas oil (LFGO) was collected in a calibrated beaker. The heating was stopped when the lighter fraction volume reaches to value of volume estimated from the ASTM-D86 distillation corresponding to 312° C. to facilities the retention of refractive sulfur compounds in heavy fraction of gas oil (HFGO) and to maximize the lighter fraction of gas oil which can be directly processed in hydrotreating. The ceramics beads, capillary tubes and other inert material were fed with the feed in distillation assembly to avoid the bumping of oil.

Properties of fractions generated from the SRGO using batch distillation are given in Table 3. Sulfur type specification of LFGO and HFGO carried out Pulsed Flame Photometric Detector (PFPD) inbuilt gas chromatography is given in FIG. 2.

TABLE 3

| Properties of Gas Oil's Fractions | | | | | |
|---|---|---|---|---|---|
| | | | ASTM-D86 | | |
| Property | LFGO | HFGO | Vol. % | LFGO | HFGO |
| Density @ 20° C. | 0.83716 | 0.87370 | IBP | 228.2 | 318.9 |
| Sulfur, wt % | 1.04 | 1.81 | 5 | 249.4 | 330.2 |
| RI at 20° C. | 1.4662 | 1.4890 | 50 | 274.6 | 343.2 |
| Mono-aromatics, wt % | 11.7 | 14.7 | 95 | 317.0 | 394.6 |
| Diaromatics, wt % | 9.6 | 11.2 | FBP | 362.8 | 395.4 |
| Polyaromatics, wt % | 3.3 | 8.9 | D | 98.0 | 97.6 |
| Non-aromatics, wt % | 75.2 | 65.2 | R/L | 1.6/0.4 | 1.9/0.5 |

IBP: Initial Boiling Point;
FBP: Final Boiling Point;
D: Distillate;
R: Residue;
L: Loss The results shown in Table 1, 2 and FIG. 2 indicate refractive sulfur and polyaromatics compounds have been segregated in heavy fraction of gas oil (HFGO). The concentration of total sulfur, refractive sulfur compounds and polyaromatics compounds in HFGO is higher by about 34%, 57% and 62%, respectively with respect to gas oil. Moreover, the concentration of total sulfur, refractive sulfur compounds and polyaromatics compounds in HFGO with respect to light fraction of gas oil (LFGO) is higher by about 74%, 216%, and 169%, respectively. This implies that refractive sulfur and di & poly aromatics compounds have been segregated in heavy fraction of gas oil. The flow rate of LFGO is 57% of gas oil.

It is essential to highlight the fact that in the present invention a single stage distillation without using reflux was used for fractionation of gas oil. The separation of refractive sulfur compounds and polyaromatics will be sharper with minimum carryover of refractive sulfur compounds and polyaromatics in lighter fraction of gas oil in multistage distillation column with reflux provision being used in actual plant. This will further enhance the concentration of refractive sulfur compound and polyaromatics in heavy fraction and reduce the concentration of these compounds in lighter fraction of gas oil. Hence, sharp separation of above mentioned compounds between LFGO and HFGO will improve the performance of overall integrated process.

Example 2

The refractory sulfur and aromatics rich heavy fraction of gas oil (HFGO) was processed in a continuous counter current packed column (10 mm internal diameter, filled up to 140 mm of its height with 2.3 to 3.0 mm structured cannon packing) using N,N-Dimethylformamide (DMF) solvent at solvent to feed ratio (S/F) of 2.0 and temperature of 45° C. The flow rate of HFGO and DMF were maintained at the value of 2 and 4 ml/min, respectively. The small amount of solvent from HFGO raffinate was removed by using the three time water washing. The moisture of solvent free raffinate was removed using anhydrous CaCl2. The Raffinate stream has the properties: density @ 20° C.=0.83316 g/cm; total sulfur=0.43 wt %; mono-aromatics=8.9 wt %; diaromatics=1.4 wt % and polyaromatics=0.9 wt %.

The compositional comparative analysis of HFGO and raffinate of HFGO reveals that there is drastic reduction in concentration of total sulfur, mono-aromatics, diaromatics and polyaromatics in raffinate. The % reduction of total sulfur, mono-aromatics, diaromatics and polyaromatics in raffinate is 76.2, 39.5, 87.5 and 89.9%, respectively.

In the present invention, loss of desired material is minimized. Solvent extraction of HFGO consisting of 43% of gas oil fraction results in raffinate volumetric yield of 71.5% along with drastic reduction of total sulfur, mono-aromatics, di-aromatics and polyaromatics concentration in raffinate by 76.2, 39.5, 87.5 and 89.9%, respectively.

Example 3

This example illustrates that quantitative effect of integrated process on the performance of hydrotreating zone for sulfur and di & poly aromatics removal. The hydrotreating of gas oil (GO), light fraction of gas oil (LFGO), raffinate of heavy fraction of gas oil (RHFGO), and mixture of LFGO and RHFGO (LFHFRM) comprising of in the ratio of their generation from gas oil was carried out in the block out mode in a fixed bed microreactor in presence of Co—Ni—Mo—P/γ-$Al_2O_3$ catalyst at various hydrogen to oil ratios, reaction temperature of 350° C., pressure of 40 bars and weight hour velocity (WHSV) 1.0-1.5 $h^{-1}$. The total sulfur analysis of samples collected during the hydrotreating experiments is given in Table 4.

TABLE 4

Sulfur Content (ppmw) of Hydrotreated Streams at Different Hydrogen to Oil Ratio at Temperature-350° C.; Pressure-40 Bar; WHSV: 1.0[1)] and 1.5[2)] $h^{-1}$

| | $H_2$/oil Ratio by Volume | | | |
|---|---|---|---|---|
| Stream | 500 | 1000 | 1500 | 2000 |
| [1)]GO | 835 | 245 | 204 | 149 |
| [2)]GO | 827 | 417 | 328 | 417 |
| [2)]LFGO | 194 | 113 | 85 | 133 |
| [2)]RHFGO | 220 | 100 | 135 | 142 |
| [2)]LFHFRM | 202 | 122 | 73 | 86 |

Results (Table 4) indicate that sulfur reduction increases with increase in the hydrogen partial pressure up to a certain value and then it increases. Hydrodynamic of reactor (contact between reactant and catalyst) and properties of feed may be possible reasons for the same.

Example 4

The properties of best hydrotreated samples (containing minimum total sulfur) obtained from feed streams (GO, LFGO, RHFGO and LFHFRM) mentioned in example 3 to hydrotreater are tabulated in Table 5.

TABLE 5

Physio-Chemical Properties of Best Samples Containing Minimum Total Sulfur

| Property | GO | LFGO | RHFGO | LFHFRM |
|---|---|---|---|---|
| Density @ 20° C. | 0.83666 | 0.82377 | 0.82463 | 0.82595 |
| Total Sulfur, ppmw | 328 | 85 | 100 | 73 |
| RI @ 20° C. | 1.4674 | 1.4631 | 1.4623 | 1.4600 |
| Mono-aromatics, wt % | 13 | 17 | 13.4 | 9.36 |
| Di-aromatics, wt % | 2.6 | 1.3 | 0.9 | 0.48 |
| Polyaromatics, wt % | 1.8 | 0.6 | 0.6 | 0.36 |
| Non-aromatics, wt % | 82.6 | 81.1 | 85.1 | 89.8 |
| Hydrodesulfurization performance factor ($HP_F$) | 1.0 | 7.9 | 5.6 | 12.1 |

It is evident from the results that sulfur, di&poly aromatic compound concentration in hydrotreated mixed stream (LFHFRM) is minimum. With respect to the best hydrotreated sample of gas oil, the concentration of total sulfur and di and polyaromatics in hydrotreated LFHFRM is lower by 77.7%, 81.5% and 80%. The momentous reduced concentration of di and poly aromatics in hydrotreated LFHFRM reveals the potential of process to enhance the cetane number of hydrotreated gas oil without increasing the severity of operating conditions of hydrotreating zone. Moreover, lowest concentration level sulfur and aromatic compounds in best sample of hydrotreated LFHFRM in comparison to best sample of hydrotreated LFGO and RHFGO streams implies that the composition of LFHFRM obtained by mixing LFGO and RHFGO streams also playing an important role in improving the performance of hydrotreating zone.

Example 5

Example 4 clearly reveals that hydrotreating zone performance is much better (sulfur in hydrotreated product=73 ppmw) in integrated process compared to stand alone hydrotreating sulfur in hydrotreated product=328 ppmw) under same operating condition of temperature, pressure and catalyst's loading and activity. The quantitative effect of integrated process on ease of sulfur removal from various sample streams (LFGO, RFGO and LFHFRM) with respect to gas oil (GO) can be understood by estimating hydrodesulphurization performance factor ($HP_F$) using sulfur content of the best hydrotreated products of different gas oil fractions for targeting the specific sulfur content in product using equation given below.

$$HP_F = \frac{\left(\begin{array}{c}\text{Sulfur in Hydrotreated } GO - \\ \text{targeted sulfur in product}\end{array}\right)}{\left(\begin{array}{c}\text{Sulfur in Hydrotreated pretreated fraction of } GO - \\ \text{targeted sulfur in product}\end{array}\right)}$$

The values of hydrodesulphurization performance factor ($HP_F$) for targeting the Euro IV gas oil containing sulfur ≤50 ppmw are given in Table 6.

TABLE 6

| Hydrodesulphurization Performance Factor ($HP_F$) | | | | |
|---|---|---|---|---|
| | Sample | | | |
| Property | GO | LFGO | RHFGO | LFHFRM |
| Sulfur content, ppmw | 328 | 85 | 100 | 73 |
| Hydrodesulfurization performance factor ($HP_F$) | 1.0 | 7.9 | 5.6 | 12.1 |

$HP_F$ values given in Table 6 clearly suggest the drastic improvement in the performance of sulfur removal efficiency of integrated process without any increase in reaction conditions severity in hydrotreating zone.

The sulfur content of hydrotreated stream using the commercial reactor using same operating conditions of temperature and pressure as used in laboratory micro reactor will be noticeable lower than that obtained in the laboratory micro reactor due to channeling and unreacted feed slip in the microreactor reactor. The metal concentration in hydrocarbon fraction depends on its boiling range. Higher the boiling range leads to higher metal concentration. In the process of present invention only lighter fraction of gas oil along with raffinate of heavy fraction of gas oil is treated in hydrotreating zone. Metals are being polar in nature; they will concentrate in extract hydrocarbon during solvent extraction of heavy fraction of gas oil with polar solvent. Thus, feed to hydrotreater zone shall have reduced metal (removed with extract hydrocarbon in extraction of heavy fraction of gas oil) and drastically lower concentration of polyaromatics compounds. This will diminish the tendency of catalyst deactivation due to metal and polyaromatics in feed. Person skilled in the art can understand that integrated process of present invention facilitates the opportunity of using more active catalyst with diminishes risk of catalyst deactivation to generate gas oil containing sulfur less than 10 to 50 ppmw using integrated process of present invention with mild operating conditions in hydrotreating zone.

Moreover, an experimental study reported in open literature reveals that increase in concentration of di and polyaromatics in model diesel (gas oil) fuel decrease the sulfur intake capacity of adsorbent drastically in adsorptive desulfurization. The integrated process of present invention generates the gas oil having very low concentration of di and polyaromatics compounds. The final gas oil produced in integrated process using adsorptive desulfurization will very fruitful to reduce the sulfur level to less than 10 ppmw.

Example 6

One of the major challenges for refiners in producing the low sulfur gas oil is to meet the drastic increase in hydrogen consumption in high severity standalone hydrotreating process due to saturation of di and polyaromatics. Hydrogen is very expensive and its generation unit is highly capital intensive. Therefore, either installation or revamp of existing hydrogen generation unit for capacity enhancement will result in huge capital investment. Person skilled in the art can understand that hydrogen consumption in integrated process of present invention will be significant lower compared to stand alone hydrotreating process as feed to hydrotreating zone in integrated process has much reduced concentration of refractive and polyaromatics compounds compared to gas oil. Thus, it is quite possible that process of present invention shall eliminate need of revamp of existing hydrogen generation plant or setting up the new grass root hydrogen generation plant. The approximate quantitative hydrogen consumption savings in integrated process compared to stand alone hydrotreating zone can be obtained by estimating the chemical hydrogen consumption for sulfur and aromatic removal from mixture of LFGO and RHFGO (LFHFRM) and gas oil (GO) processing in hydrotreated zone to produce the gas oil product having the sulfur and aromatic concentration equivalent to the best hydrotreated sample produced in integrated process of present invention (LFHFRM, S=73 ppmw). The correlations based on first principle of stoichiometry to estimate the hydrogen consumption for sulfur removal ($H_{HDS}$) and aromatic saturation and removal ($H_{HAS}$) are given below.

$$H_{HDS} = \left[3\left(S_f\frac{10BT_f}{32} - S_p\frac{Y_pBT_p}{320}\right) + 2\left(S_f\frac{10DBT_f}{32} - S_p\frac{Y_pDBT_p}{320}\right)\right]22.4\frac{\rho_f}{100}$$

$$H_{HAS} = \left[\begin{array}{c} 2\left(\frac{TA_f1000}{Mw_f} - \frac{TA_p10Y_p}{Mw_p}\right) + \\ 2\left(\frac{(DA_f + TA_f - TA_p)1000}{Mw_f} - \frac{DA_p10Y_p}{Mw_p}\right) + \\ 3\left(\frac{(MA_f + TA_f + DA_f - TA_p - DA_p)1000}{Mw_f} - \frac{MA_p10Y_p}{Mw_p}\right) \end{array}\right] 22.4\frac{\rho_f}{100}$$

$$Mw = 0.01077T_b^{\left[1.52869+0.06486ln\frac{T_b}{1078-T_b}\right]/\rho}$$

where, S, BT and DBT denotes the sulfur content, benzothiophenic sulfur % of total sulfur, and dibenzothiophenic sulfur % of total sulfur. MA, DA and TA represents to monoaromtaics, diaromatics and triaromatics concentration in weight %. $T_b$ is normal boiling point or 50% TBP or 50% ASTM+4.5 in K and p is density @ 20° C. in kg/l. Subscript f and p denote feed and product respectively. As used herein, the term triaromatics represents polyaromatics term used in analysis table and shall include all the aromatics compounds having more than two aromatic rings.

The estimated hydrogen consumption values for processing of gas oil (GO) in standalone hydrotreating zone and LFRHFGO stream generated in integrated process are given in Table 7.

TABLE 7

| Estimated Hydrogen Consumption | | |
|---|---|---|
| Hydrogen consumption | Gas oil (GO) | LFRHFGO |
| Sulfur removal ($H_{HDS}$), $Nm^3/m^3$ of feed | 22.6 | 11.8 |
| Aromatic removal ($H_{HAS}$), $Nm^3/m^3$ of feed | 82.5 | 42.8 |
| Total | 105.1 | 54.6 |

Hydrogen consumption to produce same quality of gas oil in term of sulfur and aromatic contents of hydrotreated gas oil (LFRHFGO) in integrated process is 48.1% lower compared to stand alone hydrotreating process. Person of ordinary skilled in the art can understand that this hydrogen saving will increase with increase in sulfur and aromatics concentration in gas oil to be processed for generating low sulfur gas oil. Moreover, the huge reduction in hydrogen consumption shall provide an opportunity to save huge financial investment for revamping the hydrogen plant or installing a new hydrogen plant to meet high hydrogen demand to produce gas oil having very low sulfur and aromatic concentration as expected in future to reduce the hazardous emission of gas oil combustion into environment.

Example 7

This example illustrates the importance of pseudo raffinate generation from extract phase obtained in example 2 for minimizing the loss of desired martial with sulfur and aromatic rich stream, generating the feed stock to secondary conversion process to produce low sulfur gas oil and improving the quality of sulfur and aromatic compounds rich stream (extract hydrocarbons) for its value addition so as it can be used as carbon black feed stock (CBFS) material which market value is comparable to transportation gas oil.

Pseudo raffinate (hydrocarbon rich phase) was generated using single stage mixer settler by adding given amount of water (anti-solvent) in extract phase obtained from the continuous counter current extraction column. Three experiments were carried out for generating the pseudo raffinate streams by mixing the three different quantity of water in 500 ml of extract phase in batch mixer settler in block out mode to understand the effect of quantity of water on properties of pseudo raffinate and remaining extract hydrocarbon. The mixture of extract phase and water in mixture settler was first retained for 15 min at 40° C. to reach the equilibrium temperature. Then mixture was stirred for 5 min and then 45 min was provided for phase separation. The pseudo raffinate was collected and water washed. The traces of water were removed using the anhydrous $CaCl_2$. The properties of pseudo raffinate and extract phase hydrocarbon generated corresponding to the different quantity of water used as anti-solvent are given in Table 8.0. To understand the feasibility of extract hydrocarbon utilization as a carbon black feed stock (CBFS), bureau of mines correlation index (BMCI) value which is indication of quality of black carbon feed stock for extract hydrocarbon stream was estimated using the following correlation [Mektta and Cunningham, 1990]:

$$BMCI=473.7S_g-456.8+(48460/T_b)$$

Where, $S_g$ is liquid specific gravity at 60° F. and $T_b$ represents the average boiling point (K).

TABLE 8

Properties of Pseudo Raffinate Streams and Extract Hydrocarbons

| Pseudo Raffinate Samples | | | |
|---|---|---|---|
| Parameter | PSR1 | PSR2 | PSR3 |
| Amount of water added to extract phase, ml | 11.2 | 23.0 | 35.5 |
| Density@ 20.0° C. | 0.87886 | 0.89078 | 0.9109 |
| Total Sulfur, wt % | 1.33 | 2.19 | 2.76 |
| Percent Yield[(1)] | 4.7 | 7.7 | 9.8 |

| Extract Samples | | | | |
|---|---|---|---|---|
| Property | CRE | PSE1 | PSE2 | PSE3 |
| Specific gravity @ 15.5 | 0.97755 | 0.9968 | 1.0087 | 1.0144 |
| BMCI | 84.8 | 93.9 | 99.5 | 102.2 |

[(1)]Percent yield of Pseudo Raffinate = (Volume of raffinate/Volume of initial gas oil)*100
BMCI: Bureau Of Mines Correlation Index;
CRE: Extraction from continuous extraction experiment;
PSR: pseudo raffinate;
PSE: Extract from mixture settler pseudo raffinate Results given in Table 8.0 indicate that sulfur content in pseudo raffinate stream, % yield of pseudo raffinate and BMCI value of extract hydrocarbon depends on the quantity of water added to extract phase obtained from packed bed column. The quantity of water can be adjusted to a certain value to provide the minimize loss of desired saturates material in extract hydrocarbon and to meet the quality of extract hydrocarbon to be used as CBFS and quantity and quality of Pseudo raffinate to meet the feed specification of secondary processing units. The pseudo raffinate which a small fraction of gas oil can be routed to existing hydrocracker which is designed for processing of heavy fraction of gas oil without any revamp to produce very low sulfur gas oil in the range of 2-10 ppmw. No prior art teaches above mentioned aspects to improve the process economics.

It is worth to note that 88% of gas oil is processed in hydrotreating zone and depending up on the available design margin, generated pseudo raffinate can be treated in hydrocracker to produce clean and very low sulfur gas oil. Thus, integrated process facilitates to convert most of the gas oil into low sulfur gas oil under mild operating condition of hydrotreating zone and balance of gas oil as CBFS or feed to cocker or aromatics rich rubber processing solvent.

The performance of integrated process can further improve by fine tuning operating conditions of fractional distillation, solvent to feed ratio, anti-solvent concentration in main solvent or mixture of solvents in extraction zone of HFGO, fine tuning of water amount in pseudo raffinate generation zone. Moreover, sharp fraction of full range gas oil in light and heavy fractions using the multi stage distillation will also improve the performance of the proposed process.

Advantages of the Invention

The present invention offers distinct benefits over the conventional processes of deep desulfurization disclosed in prior art.

- Provides a cost effective process with simple, compact and energy efficient solvent recovery system and flexibility in solvent selection.
- No oxidative step is involved.
- Significant reduction in hydrogen consumption.
- Can avoid the need of either revamp of existing hydrogen generation plant or setting up the new grass root hydrogen generation plant (which is very capital intensive).
- Integrated process provides the opportunity to save huge investment required for retrofitting of existing facilities for deep desulfurization of gas oil.
- Generate suitable carbon black feed stock (CBFS) for carob black generation.
- Have full flexibility in term of optimizing the quantity and quality of feed stock for existing hydrocracker and carbon black generation unit and feed to hydrotreating zone.
- The operating conditions values of microreactor used in the examples 3 are below the design value of pressure and temperature. This implies that integrated process of present invention can be easily implemented in the refineries for economical retrofitting of existing hydrotreating equipment designed for generating gas oil with sulfur content ranging from 350-500 ppmw to produce sulfur in final product less than 70 ppmw.
- Integrated process of present invention is cost effective due to its simple configuration, flexible and easy to implement thereby has huge commercial values.

Although the invention has been described with reference to the above examples, it will be understood that modifications and variations are encompassed within the spirit and scope of the invention. Accordingly, the invention is limited only by the following claims.

What is claimed is:

1. An integrated process for simultaneous removal and value addition to sulfur and aromatics compounds of a gas oil comprising:

(i) distilling a gas oil under vacuum or positive pressure in the range of 40-2280 mm Hg and a temperature in the range 100-350° C. to obtain a refractive sulfur and polyaromatics lean lighter fraction of gas oil (LFGO), and a refractive sulfur and polyaromatics rich heavy fraction (HFGO) of gas oil;

(ii) mixing the HFGO obtained in step (i) with a polar solvent in a continuous extraction column at a temperature in the range of 30 to 70° C. with a solvent to feed ratio in the range of 0.5 to 4.0 to obtain a raffinate lean in refractive sulfur and polyaromatics and an extract rich in refractive sulfur and polyaromatics compounds;

(iii) washing the raffinate obtained in step (ii) with water generating water containing a small amount of solvent and a solvent free raffinate;

(iv) mixing the extract obtained in step (ii) with an anti-solvent in a single stage mixture settler, to obtain a pseudo raffinate (PSR) hydrocarbon and a solvent rich extract containing an enhanced concentration of sulfur and aromatic compounds;

(v) subjecting the solvent rich extract obtained in step (iv) and the water containing a small amount of solvent obtained from wash zones obtained in step (iii) to a solvent recovery column for recovery of an aqueous solvent and an extract hydrocarbon stream;

(vi) distilling the aqueous solvent obtained in step (v) to separate water and dry solvent with a water concentration in the range of 0.0 to 10.0% for its reuse in the process;

(vii) subjecting a fraction of the pseudo raffinate (PSR) hydrocarbon obtained in step (iv) in the range of 5% to 50% to a continuous extraction column;

(viii) subjecting a portion of the pseudo raffinate (PSR) hydrcarbon obtained in step (iv) in the range of 50% to 95% to a hydrocracker to obtain a gas oil of reduced sulfur and aromatics level, wherein the gas oil has sulfur less than 10 ppmw;

(ix) routing the extract hydrocarbon stream obtained in step (v) as a feed stock to carbon black generation unit to produce carbon or delayed coker unit to obtain reduced sulfur products;

(x) hydrotreating the refractive sulfur and polyaromatics lean lighter fraction of gas oil (LFGO) obtained in step (i), the solvent free raffinate as obtained in step (iii), or a mixture of the LFGO and the solvent free raffinate in the presence of hydrogen and metallic catalyst to produce a desulfurized gas oil having sulfur less than 75 ppmw; and (xi) blending of the desulfurized gas oil having sulfur less than 75 ppmw obtained in step (x) with the gas oil having sulfur less than 10 ppmw obtained in step (viii) to produce a blended low sulfur gas oil wherein the sulfur in the blended low sulfur gas oil is less than 70 ppmw.

2. The process of claim 1, wherein the gas oil used in step (i) comprises monoaromatic compounds in the range of 10-20 wt %, diaromatics compounds in the range of 10-30 wt polyaromatics compounds in the range of 3-25 wt %; nonaromatic compounds in the range of 35 to 80% and sulfur content in the range of 0.2 to 4.0 wt %.

3. The process of claim 1, wherein the volume of lighter fraction of gas oil from step (i) is in the range of 30 to 80% of gas oil.

4. The process of claim 1, wherein the polar solvent used in step (ii) is selected from a group consisting of N dimethyl formamide (DMF), N dimethyl acetamide (DMA), N methyl 2 pyrilidone (NMP), furfural, ethylene glycol, diethylene glycol, and acetonitrile.

5. The process of claim 1, wherein the anti-solvent used in step (iv) is selected from water, methanol, ethanol and propanol.

6. The process of claim 1, wherein the mixture settler of step (i) operates with a ratio of the extract and the anti-solvent in the range of 100:5 and temperature in the range of 30 to 70° C. to obtain the pseudo raffinate hydrocarbon and the solvent rich extract hydrocarbon of desired purity.

7. The process of claim 1, wherein hydrotreating reaction is operated under mild reaction condition with a reactor pressure in the range of 20 bar to 40 bar, reactor temperature in the range of 300 to 400° C. with weight hour space velocity of feed in the range of 0.5 to 3.0 $h^{-1}$ in presence of metallic hydrotreating catalyst.

8. The process of claim 1, wherein feeding the clean feed lean in refractive sulfur, di and poly aromatics compounds to the hydrotreating zone of step (x) for reduces the chemical hydrogen consumption for sulfur and aromatics removal from gas oil by 30 to 80% compared to feeding the gas oil to the hydrotreating zone.

9. The process of claim 1, wherein the volume of lighter fraction of gas oil from step (i) is in the range of 40 to 70% of gas oil.

10. The process of claim 1, wherein the volume of lighter fraction of gas oil from step (i) is in the range of 50 to 60% of gas oil.

11. The process of claim 1, wherein the mixture settler of step (iv) operates with a ratio of the extract and the anti-solvent in the range of 80:10 and temperature in the range of 30 to 70° C. to obtain the pseudo raffinate hydrocarbon and the solvent rich extract hydrocarbon of desired purity.

12. The process of claim 1, wherein the mixture settler of step (iv) operates with a ratio of the extract and the anti-solvent in the range of 40:15 and temperature in the range of 30 to 70° C. to obtain the pseudo raffinate hydrocarbon and the solvent rich extract hydrocarbon of desired purity.

13. The process of claim 4, wherein the polar solvent further comprises water.

14. The process of claim 4, wherein the polar solvent is selected from the group consisting of N dimethyl formamide (DMF), N dimethyl acetamide (DMA), N methyl 2 pyrilidone (NMP), furfural, ethylene glycol, diethylene glycol, acetonitrile and water or combination thereof.

* * * * *